United States Patent [19]

Ibuchi

[11] Patent Number: 4,748,470

[45] Date of Patent: May 31, 1988

[54] AUTOMATIC DUPLEX ELECTROPHOTOGRAPHIC COPYING MACHINE

[75] Inventor: Yoshiaki Ibuchi, Nara, Japan

[73] Assignee: Sharp Kabushiki Kaisha, Osaka, Japan

[21] Appl. No.: 48,964

[22] Filed: May 13, 1987

Related U.S. Application Data

[63] Continuation of Ser. No. 807,441, Dec. 10, 1985, abandoned.

[30] Foreign Application Priority Data

Dec. 10, 1984 [JP] Japan ..... 59-262173

[51] Int. Cl.[4] ..... G03G 15/00

[52] U.S. Cl. ..... 355/3 R; 355/3 SH; 355/26

[58] Field of Search ..... 355/3 R, 3 SH, 14 SH, 355/23-26

[56] References Cited

U.S. PATENT DOCUMENTS

| | | | |
|---|---|---|---|
| 4,365,886 | 12/1982 | Murakami et al. | 355/3 SH |
| 4,433,905 | 2/1984 | Haramaki et al. | 355/3 SH |
| 4,534,643 | 8/1985 | Watanabe | 355/3 SH |
| 4,537,497 | 8/1985 | Masuda | 355/3 SH X |
| 4,573,789 | 3/1986 | Wada | 355/3 SH X |

FOREIGN PATENT DOCUMENTS

| | | | |
|---|---|---|---|
| 3247142 | 10/1983 | Fed. Rep. of Germany . | |
| 58-184165 | 7/1983 | Japan . | |
| 59-211060 | 11/1984 | Japan | 355/3 SH |

*Primary Examiner*—Arthur T. Grimley
*Assistant Examiner*—J. Pendegrass
*Attorney, Agent, or Firm*—Birch, Stewart, Kolasch & Birch

[57] ABSTRACT

An automatic duplex electrophotographic copying machine comprises a copying machine main body including a toner image transfer portion, a sorter having switch-back device to reverse the travel direction of a copy paper and wherein the sorter is to be mounted on the copying machine main body near a paper outlet, and a desk for mounting the copying machine main body and including a transport device communicating from the sorter to the paper feeding section of the copying machine main body. The copying machine main body, the sorter and the desk are detachable from one another. In the duplex copying mode, a single-side copied paper discharged from the paper outlet of the copying machine main body is turned over by the switch-back device in the sorter and transported by the transport device in the desk back to the toner image transfer portion.

3 Claims, 3 Drawing Sheets

AUTOMATIC DUPLEX ELECTROPHOTOGRAPHIC COPYING MACHINE

This application is a continuation of application Ser. No. 807,441, now abandoned, filed on Dec. 10, 1985.

BACKGROUND OF THE INVENTION

The present invention relates to an electrophotographic copying machine and, more particularly, to an automatic duplex electrophotographic copying machine.

An electrophotographic copying machine produces onto a photoreceptor an electrostatic latent image corresponding to an image of a document such as a manuscript or book to be copied. Toner particles are electrostatically adhered to the latent image, so that the latent image becomes visible as a toner image. The toner image on the photoreceptor is transferred onto a copy paper via a transference charger. The remaining toner particles and charges on the photoreceptor after the transfer arae removed for the next copying operation.

There is present an improved electrophotographic copying machine of the type in which the images on two sheets of documents can be copied onto both sides of one or more copy papers, which is referred to herein as a "duplex copying machine". In such a machine, after the image of a sheet of document has been copied on a single side of a copy paper, the copy paper is turned over to be transported toward the toner image transfer portion, so that the next image is copied onto the other side of the single-side copied paper.

More specifically, in order to realize the above mentioned automatic duplex electrophotographic copying function, the machine involves switch-back means to reverse the travel direction of a single-side copied paper and transport means to convey the reversed single-side copied paper back to the toner image transfer portion. In a conventional copying machine with an automatic duplex copying function, the switch-back means are provided within the machine main body near the copy paper outlet and the transport means under the main paper passage so that a single-side copied paper is turned over within the machine main body to be transported back to the toner image transfer portion. Consequently, the conventional copying machine incorporates therewithin an intricate mechanism related to automatic duplex copying function and, therefore, is of large size. Moreover, the machine has a quite different construction compared with a copying machine with no automatic duplex copying function and, therefore, needs to be produced on a different production line from that for producing the type with no automatic duplex copying function. This results in cost rise. Furthermore, because of the difference in construction as described above, it is not possible to add the automatic duplex copying feature as an option to the copying machine with no automatic duplex copying function. Namely, it is not possible to add automatic duplex copying feature to an ordinary single-side copying machine.

SUMMARY OF THE INVENTION

In view of the foregoing, the object of the present invention is to provide an automatic duplex copying machine whose switch-back means and transport means related to an automatic duplex copying function are installed outside the machine. As a result, the copying machine of the present invention is of a small size and can be produced at a lower cost on the same production line as a copying machine with no automatic duplex copying function.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

In accordance with the present invention, the transport means related to the automatic duplex copying function is provided under the main paper passage.

The automatic duplex copying machine of the present invention comprises a copying machine main body including a toner image transfer portion, a sorter that has switch-back means to reverse the travel direction of a copy paper and which is mounted to the copying machine main body near a paper outlet, and a desk to mount the copying machine main body and which is provided with transport means to communicate the sorter with the paper feeding section of the copying machine main body, the transport means including a paper reservoir at its mid portion, the copying machine main body, the sorter and the desk being detachable from one another. In the duplex copying mode, a single-side copied paper discharged from the paper outlet of the copying machine main body is turned over by the switch-back means of the sorter to be conveyed on the transport means in the desk toward the toner image transfer portion.

BRIEF DESCRIPTION OF THE DRAWINGS

The present invention will be better understood from the detailed description given hereinbelow and the accompanying drawings which are given by way of illustration only, and thus are not limitative of the present invention.

DESCRIPTION OF THE INVENTION

Figure 1:
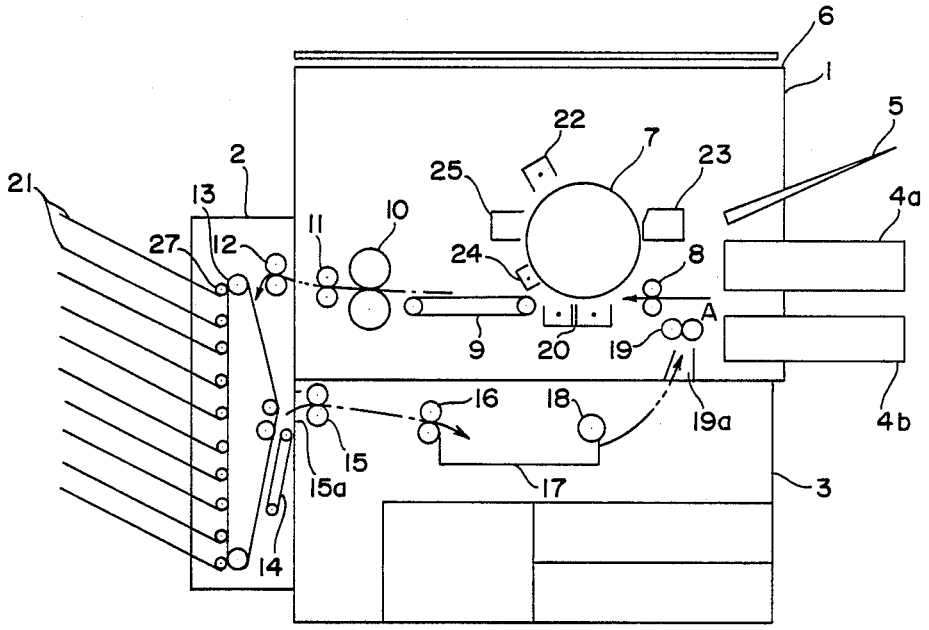
FIG. 1 schematically shows the construction of an automatic duplex copying machine of an embodiment of the present invention.

The construction of an automatic duplex copying machine of an embodiment of the present invention is schematically shown in FIG. 1.

Paper feeder cassettes 4*a* and 4*b* are attached to the paper feeding section on the right side of a copying machine main body 1. A manual paper feeding tray 5 is provided over the cassettes. The copying machine main body 1 contains a photoreceptor 7 in its approximate center. An electric charger 22, a developing unit 23, a transference and separation charger 20, a charge remover 24 and a cleaner 25 which are related to the copying process are arranged around the periphery of the photoreceptor 7 so as to constitute a toner image transfer portion. To the lower right of the transfer portion are provided transport rollers 8 that rotated synchronously with the photoreceptor 7 to feed a copy paper. Discharge rollers 11 are installed near the paper outlet at the lower left of the copying machine main body 1. To the right of the discharge rollers 11 are provided fixing rollers 10 which heat the toner image-transferred copy paper under pressure so as to fix the toner image on the copy paper. A transport belt 9 is extended around two rollers between the toner image transfer portion and the fixing rollers 10. The transport belt 9, transport rollers 8 and discharge rollers 11 constitute the main paper passage. A sorter 2 is attached on the left side of the copying machine main body 1. Copy papers with the images of a plurality of documents are sequentially delivered by the sorter 2 to a bin 21 provided on the left of the sorter 2. The bin 21 contains multiple racks onto which copy papers discharged from the outlet of the copying machine main body 1 are transported by transport rollers 12, a transport belt 13 and delivery rollers 27 each provided on each rack of the bin 21. A reverse transport belt 14 is extended around rollers on the side of the transport belt 13 opposite the bin 21. A branch claw (not shown) is provided between the transport rollers 12 and the transport belt 13, so that, in the duplex copying mode, a single-side copied paper discharged from the paper outlet is directed toward the reverse transport belt 14 located on that side of the transport belt 13 opposite the bin 21.

The copying machine main body 1 is placed on a desk 3 in the left side wall of which is formed a paper intake 15*a*. The copy paper transported by the reverse transport belt 14 enters the desk 3 through the paper intake 15*a*. Intake rollers 15 are provided adjacent the paper intake 15*a*. A paper reservoir tray 17 is positioned in the approximate center in the upper part of the desk 3. Transport rollers 16 are provided at the upper left and paper feed rollers 18 at the upper right of the paper reservoir tray 17. The copy paper fed by the paper feed rollers 18 from the paper reservoir tray 17 is transported through an unshown route to a single-side copied paper inlet 19*a* formed at the bottom of the copying machine main body 1. The thus transported copy paper is fed again to the tonerimage transfer portion by the rotating paper feed rollers 19 and transport rollers 8.

For duplex copying operation by a copying machine with the above construction, an operator turns on a copy switch on the operation panel (not shown). By the copy switch operation, the optical system starts scanning the document placed on a manuscript rest 6. Synchronously, the photoreceptor starts rotation. In synchronization with the above operation, a copy paper is supplied in the direction indicated by an arrow "A", from either of the manual paper feeding tray 5 or the paper feeder cassettes 4*a* and 4*b* that are mounted on the paper feeding section of the copying machine main body 1. The copy paper is then transported to the area between the photoreceptor 7 and the transference and separation charger 20 by the transport rollers 8 that rotate synchronously with the photoreceptor 7, so that a toner image electrostatically adhered to the surface of the photoreceptor 7 is transferred onto the copy paper. Then the copy paper travels on the transport belt 9 to the fixing rollers 10 which heat the copy paper under pressure so that the toner image is firmly fixed to the copy paper. The single-side copied paper is then discharged from the paper outlet of the copying machine main body 1 by means of the rotating discharge rollers 11. If duplex copying mode has been selected, the single-side copied paper is directed to the rear side of the transport belt 13 by the transport belt 13, the transport rollers 12 and the branch claw (not shown) provided between the transport belt 13 and the transport rollers 12 in the sorter 2. When the trailing end of the copy paper comes to the reverse transport belt 14, the rotating directions of the reverse transport belt 14 and of the transport belt 13 are inversed so that the single-side copied paper enters the desk 3 through the paper intake 15*a* by the aid of a branch claw (not shown) provided at the upper part of the reverse transport belt 14. The copy paper is then transported by the rotating intake rollers 15 and transport rollers 16 into the paper reservoir tray 17. If the setting for the number of copies to be made for one document is two or more, the above operation is repeated until the preset number of copy papers has been accumulated in the paper reservoir tray 17.

The accumulation of the preset number of copy papers is indicated on the operation panel (not shown). Then, the operator changes the document on the manuscript rest 6 to the one to be copied on the other side of the single-side copied paper. After replacement of the document, the operator turns on the copy switch again. Then, the paper feed rollers 18 start rotation to transport the accumulated single-side copied papers one by one toward the single-side copied paper inlet 19*a*. The rotation of the paper feed rollers 18 is synchronized with scanning by the optical system as well as with the rotation of the photoreceptor 7. Thus, the single-side copied paper is transported to the area between the photoreceptor 7 and the transference and separation charger 20 by the paper feed rollers 19 and the transport rollers 8. As described above, the single-side copied paper is turned over by the reverse transport belt 14 and the transport belt 13 and directed in the direction indicated by a dot-dash line in the figure, so that the other side of the single-side copied paper is faced to the photoreceptor 7. After the toner image corresponding to the image on the document is transferred onto the other side of the single-side copied paper, the copy paper is conveyed on the transport belt 9 to the fixing rollers 10 to be heated under pressure.

In the duplex copying mode, when the copy switch is turned on for the second time, the branch claw provided near the transport rollers 12 in the sorter 2 closes the paper passage indicated by the dot-dash line, and the rotation of the transport belt 13 is reversed from that for the first copying operation. Eventually, the double-side copied paper is directed by the rotating discharge rollers 11, transport rollers 12 and transport belt 13 to the side of the transport belt 13 facing the bin 21. The copy paper is then delivered by the rotating delivery rollers 27 onto the top rack identified as a storage for double-side copied papers in the bin 21. When sorting of double-side copied papers is required, a delivery guide corresponding to each sheet of document operates to store each of double-side copied papers in the specified rack in the bin 21.

Figure 2:
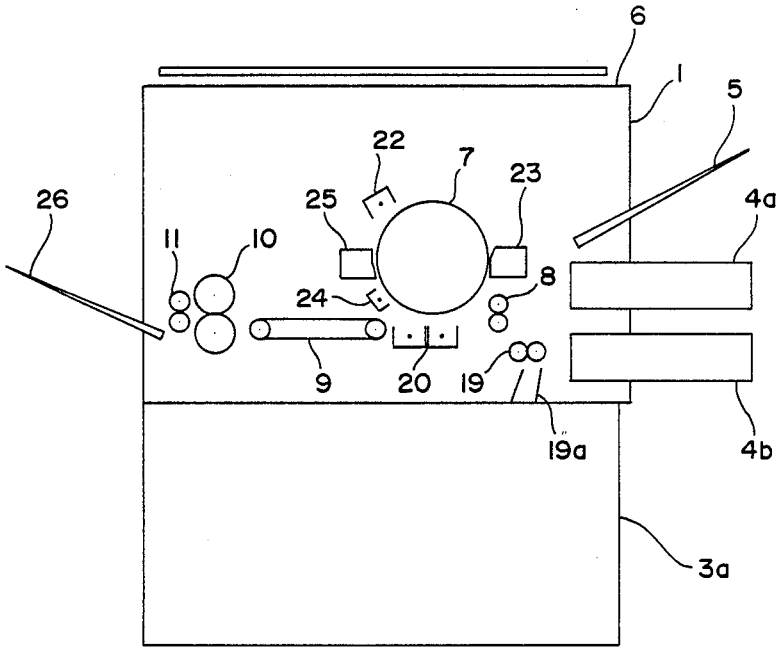
FIGS. 2 and 3 show other constructions of the embodiment in FIG. 1.
Figure 3:
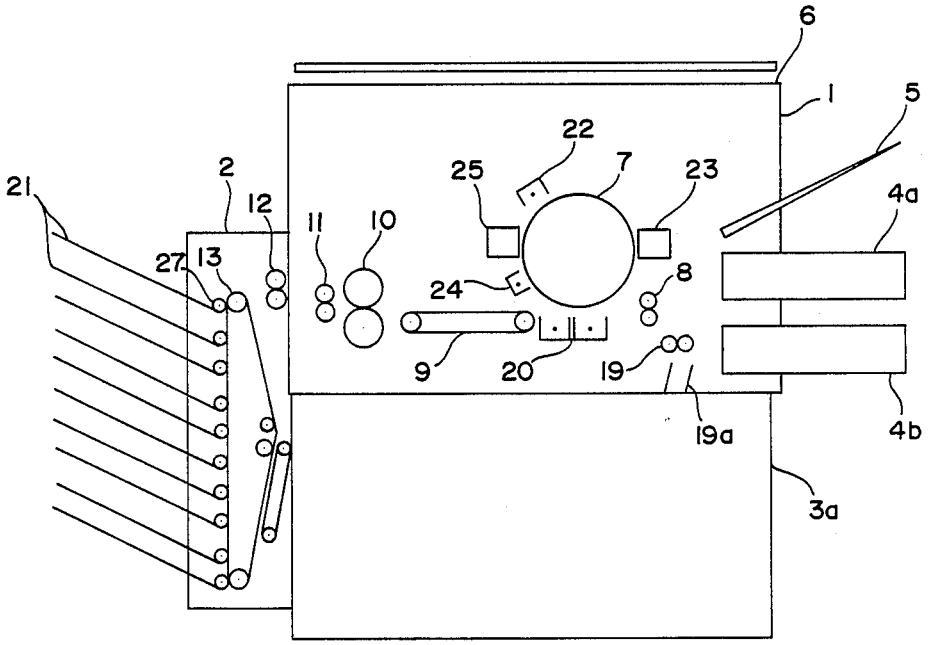

FIGS. 2 and 3 show other constructions of the automatic duplex copying machine of the present invention.

FIG. 2 shows the copying machine main body 1 mounted on a desk 3*a* which is not provided with transport means related to duplex copying function. If the user does not require automatic duplex copying function and automatic sorting function, the copying machine main body 1 alone may be installed on the desk 3*a*, to be served for single-side copying operation. As mentioned above, since the switch-back means and the transport means related to automatic duplex copying function are not provided within the copying machine main body 1, the copying machine only occupies the same space required for an ordinary copying machine with single-side copying function alone.

FIG. 3 shows the copying machine main body 1 mounted on a desk which is not provided with transport means related to duplex copying function, with the sorter 2 attached to the paper outlet thereof. If the user requires single-side copying function and automatic sorting function, the sorter 2 needs to be added to the construction shown in FIG. 2. With this combination, when a document to be copied contains a plurality of sheets, each single-side copied paper is automatically sorted and stored in a particular rack of the bin 21, corresponding to each sheet of the document.

According to the present invention, as described above, the switch-back means and the transport means related to automatic duplex copying function are provided in peripheral apparatus that are designed to be attached to the copying machine main body 1. The functions of the peripheral apparatus may be effectively utilized when the automatic duplex copying function is required, and the same copying machine main body may be utilized even when the automatic duplex copying function is not required. In addition, the peripheral apparatus containing the switch-back means and transport means related to automatic duplex copying function may be attached to a copying machine main body installed for single-side copying operation to add an automatic duplex copying function.

Further, it is possible to provide the single-side copied paper inlet and the paper feed rollers in the lower part of the copying machine main body 1 only when the automatic duplex copying function is required. The reverse transport belt in the sorter may be detachable in case the duplex copying function is not required.

As understood from the above description, according to the present invention, since the switch-back means and the transport means related to the automatic duplex copying function are provided outside the copying machine main body, the copying machine may be manufactured on the same line as a copying machine without automatic duplex copying function, and a smaller copying machine is realized at a lower cost. Moreover, a user may purchase a copying machine main body alone first and add the automatic duplex copying function later as required.

While only certain embodiments of the present invention have been described, it will be apparent to those skilled in the art that various changes and modifications may be made therein without departing from the spirit and scope of the present invention as claimed.

What is claimed is:

1. An automatic electrophotgraphic duplex copying machine comprising:

a copying machine main body including a first paper feed section, a photoreceptor and its peripheral components constituting a toner image transfer portion, a first copy paper transport system and image fixing rollers;

a desk on which said copying machine main body is mounted provided with a second copy paper transport system, inclusive of a paper reservoir positioned in the upper portion of said desk beneath said copying machine main body, which communicate with said first paper feed section through a copy paper inlet formed at the bottom of said main body; and a sorter having an upper portion and lower portion mounted vertically on said copying machine main body and said desk such that said upper portion of said sorter is juxapositioned to a copy paper outlet of said main body and said lower portion is juxtapositioned to a copy paper intake of said desk, said sorter containing a switch back mechanism completely housed therein for reversing the travel direction of a copy paper for the purpose of duplex copying, directing said copy paper to said copy paper intake and, via said second copy paper transport system, to be returned to said first paper feed section of said copying machine main body through said copy paper inlet formed at the bottom of said main body, said copying machine main body, desk and sorter being detachable from one another.

2. The automatic electrophotographic duplex copying machine of claim 1, wherein said sorter includes a bin of multiple racks onto which copy papers are discharged from said copy paper outlet of said copying machine main body by way of a delivery transport belt.

3. The automatic electrophotographic duplex copying machine of claim 2, wherein said switch back mechanism comprises a reverse transport belt positioned between said delivery transport belt and said desk opposite said bin.

* * * * *